US008056992B2

(12) United States Patent
Gassner

(10) Patent No.: US 8,056,992 B2
(45) Date of Patent: Nov. 15, 2011

(54) COUPLING FOR A MOVABLE PART OF A PIECE OF FURNITURE

(75) Inventor: Simon Gassner, Dornbirn (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 12/582,217

(22) Filed: Oct. 20, 2009

(65) Prior Publication Data

US 2010/0041484 A1 Feb. 18, 2010

Related U.S. Application Data

(63) Continuation of application No. PCT/AT2008/000064, filed on Feb. 27, 2009.

(30) Foreign Application Priority Data

Apr. 23, 2007 (AT) ..... A 628/2007

(51) Int. Cl.
*A47B 88/14* (2006.01)

(52) U.S. Cl. ..... 312/319.7; 403/DIG. 1; 403/DIG. 13

(58) Field of Classification Search ..... 312/319.7, 312/319.8; 403/297, 298, DIG. 11, DIG. 13, 403/DIG. 1; 242/390.8
See application file for complete search history.

(56) References Cited

U.S. PATENT DOCUMENTS

| | | | | |
|---|---|---|---|---|
| 4,798,569 | A * | 1/1989 | Alderfer | 403/298 X |
| 4,940,355 | A * | 7/1990 | Buchanan | 403/DIG. 11 |
| 5,564,807 | A | 10/1996 | Röck | |
| 6,523,919 | B1 * | 2/2003 | Israelsen et al. | 312/319.8 X |
| 2010/0038467 | A1 * | 2/2010 | Gassner | 242/390.8 |

FOREIGN PATENT DOCUMENTS

| | | |
|---|---|---|
| AT | 502 204 | 2/2007 |
| DE | 102 53 362 | 5/2004 |
| DE | 20 2006 008 825 | 1/2007 |
| EP | 0 635 226 | 6/1994 |
| WO | 2007/009135 | 1/2007 |

OTHER PUBLICATIONS

International Search Report issued May 27, 2008 in International (PCT) Application No. PCT/AT2008/000064.

* cited by examiner

*Primary Examiner* — Gregory Binda
(74) *Attorney, Agent, or Firm* — Wenderoth, Lind & Ponack, L.L.P.

(57) ABSTRACT

A coupling is provided for detachably connecting a mobile part of a piece of furniture to a drive. The coupling includes a coupling element that can be moved between the mobile part of the piece of furniture and the drive in a limited manner in at least one direction, in order to compensate for position tolerances in relation to the at least one direction.

9 Claims, 13 Drawing Sheets

COUPLING FOR A MOVABLE PART OF A PIECE OF FURNITURE

This application is a Continuation of International application No. PCT/AT2008/000064, filed Feb. 27, 2009, the entire disclosure incorporated herein by reference.

BACKGROUND OF THE INVENTION

The present invention concerns a coupling for releasably connecting a movable furniture part to a drive, wherein the coupling has a coupling portion. Couplings of this kind suffer from the problem that, due to positional tolerances of the movable furniture part relative to the drive, it may be difficult to make the connection between the movable furniture part and the drive. The positional tolerances may involve, for example, installation tolerances. They are to be attributed to the fact that neither the drive nor the movable furniture part is mounted exactly at the same location on a body or carcass of an article of furniture, in each mounting operation.

A further example of positional tolerances are operating tolerances which are therefore not to be attributed to inaccurate fitment of the drive or the furniture part in the furniture body or carcass, but which inevitably occur in operation of the movable furniture part. It is known, for example, that a movable furniture part which is in the form of a drawer can rise or fall by some millimeters, depending on the respective loading condition.

SUMMARY OF THE INVENTION

The object of the invention is to provide a coupling of the general kind set forth, which is suitable for overcoming the above-discussed problems. According to the invention that is attained by a coupling having the features described herein.

The provision of a limited mobility of the coupling portion in the direction to be compensated means that positional tolerances are of no consequence either in the form of installation tolerances or in the form of operating tolerances.

The concept according to the invention is admittedly not limited to a given kind of drive. A particularly preferred embodiment however is one in which it is provided that the drive has a pulling means which can be wound onto a roller drivable by an electric motor. In that case, the limited mobility of the coupling portion at least along the line of action of the drive (that is to say in or in opposite relationship to the extension direction of the movable furniture part) can be implemented by the pulling means or the roller having a certain play. In other words, even when the drive is not activated, the pulling means because of the play can be unwound from or wound onto the roller.

With this embodiment it can further be provided that the drive has a housing. Provided in the unwinding region of the roller is a window for the exit of the pulling means, and the window is substantially larger than the diameter of the pulling means. That also affords a compensation option for directions which extend in orthogonal relationship to the line of action of the drive. For example, the pulling means will generally be of a diameter of between 0.5 mm and 1 mm. In that case, it is sufficient if the window is of a dimension in the region of about 5 mm (for example in the case of a square configuration, for each side).

A further advantageous embodiment is afforded if it is provided that the coupling portion is a magnet connected to the pulling means. Movable furniture parts normally have a metallic rear wall (for example a metallic drawer body frame). In that case, the magnet can couple at any position delimited only by the pulling means anywhere on the rear side of the movable furniture part.

In another embodiment of the invention, the coupling portion has a first part for mounting to the movable furniture part and a second part for mounting to the drive.

In that case it can be provided that the second part is mounted on a slide displaceable in two mutually orthogonal directions which extend in orthogonal relationship with the line of action of the drive. That affords a compensating option in relation to positional tolerances in orthogonal relationship with the line of action of the drive.

Alternatively or additionally, the second part is mounted limitedly movably along the line of action of the drive, thereby affording a compensating option along the line of action of the drive.

Further alternatively or additionally, the second part is mounted pivotably relative to a housing of the drive. A pivotable mounting arrangement also affords compensating options both in the line of action of the drive and also in orthogonal relationship with that line of action.

BRIEF DESCRIPTION OF THE DRAWINGS

Further advantages and details of the invention will be apparent from the Figures and the related specific description. Therein, FIGS. 1 through 5 each show a separate embodiment of the invention in a perspective view (FIGS. 1*a*, 2*a*, 3*a*, 4*a*, and 5*a*), a partial exploded view (FIGS. 1*b*, 2*b*, 3*b*, 4*b*, and 5*b*), sectional views (FIGS. 1*c*, 1*d*, 2*c*, 2*d*, 3*c*, 3*d*, 4*c*, 4*d*, 5*c* and 5*d*), and a schematic diagram (FIG. 1*e*).

DETAILED DESCRIPTION OF THE INVENTION

Figure 1A:
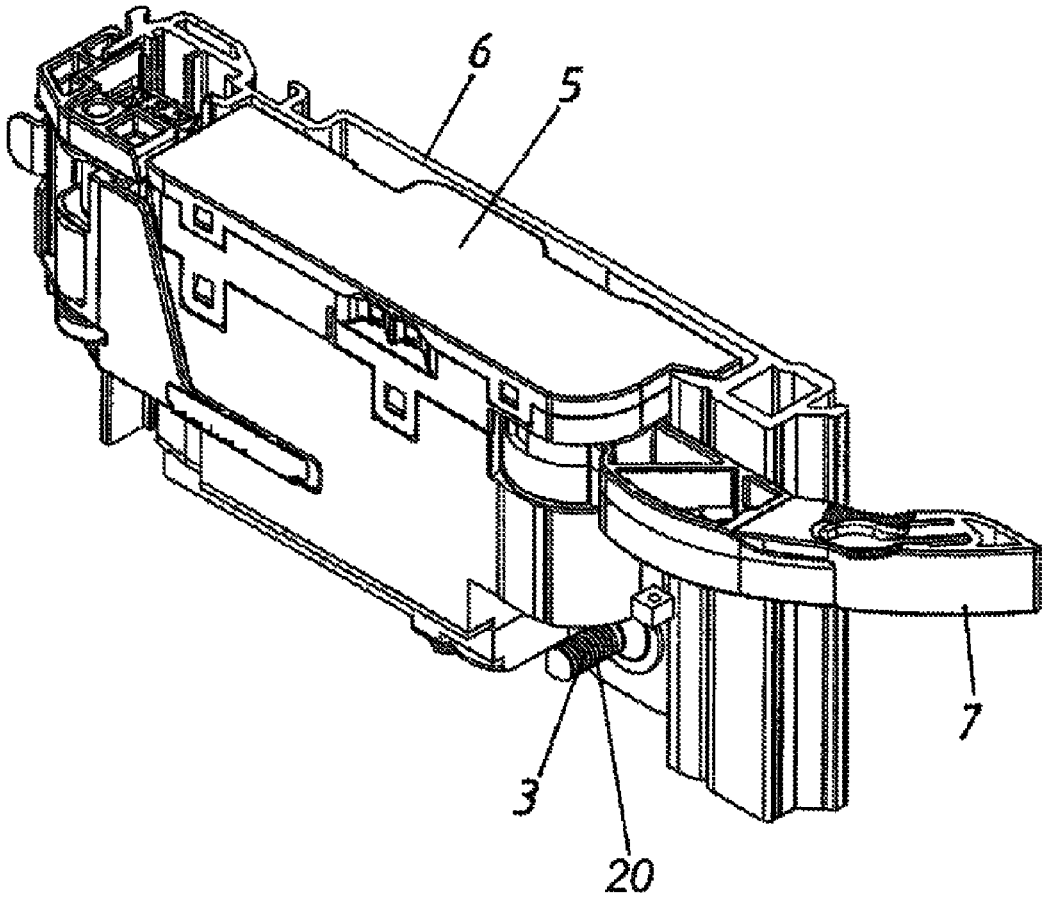

Each of the Figures shows a drive 5 which is releasably fixed to a profiled rail 6 and has an ejection lever 7 and a pull-in retraction device having a pulling member 4. As shown in the schematic diagram of FIG. 1*e*, the pulling member 4 is wound on roller 23 of drive 5, and roller 23 is driven by motor 25. The notional line of action 21 is orthogonal to the axis of rotation 24 of the roller 23. The embodiments differ in the configuration of the coupling 1. Thus, components having the same configuration in each embodiment are identified with the same reference numbers.

Thus FIGS. 1*a* through 1*d* show an embodiment of the coupling 1, in which the coupling 1 has two parts 2, 3. The first part 2 is provided for mounting to the movable furniture part 8, and the second part 3 is provided for mounting to a free end 26 of the pulling member 4 of the drive 5.

Figure 1B:
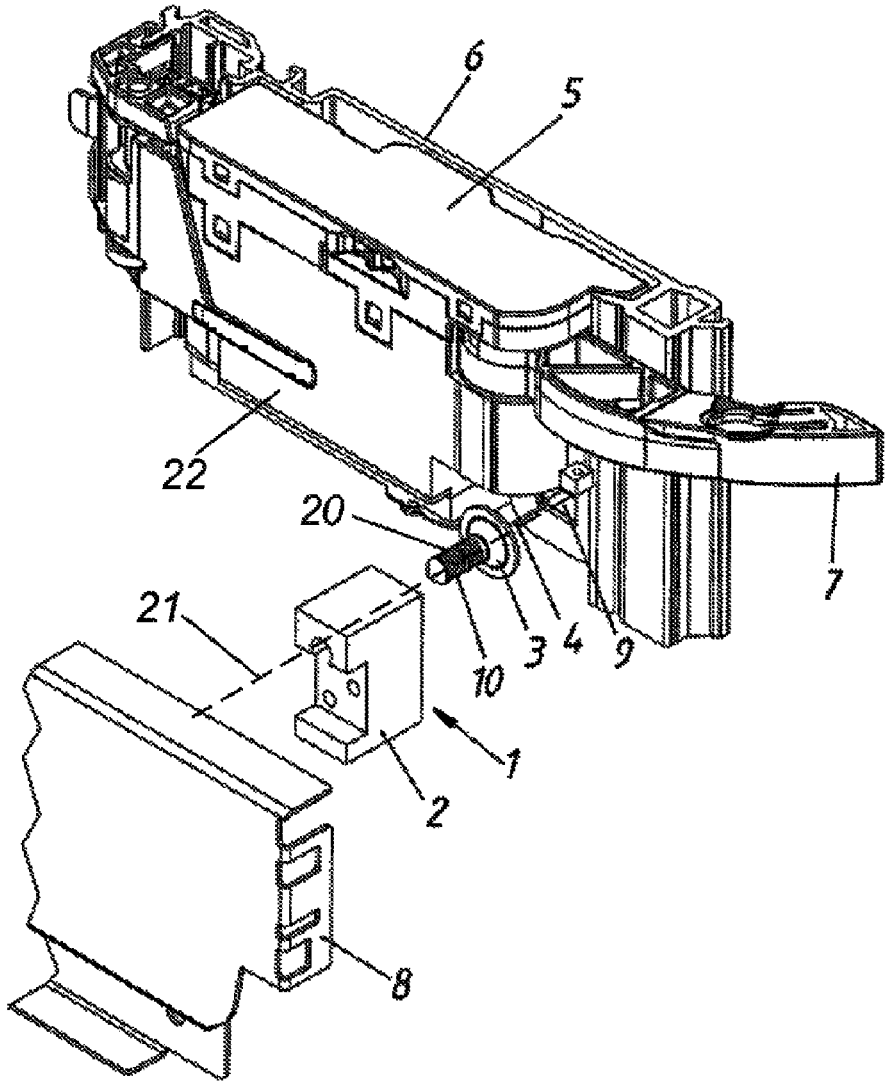
Figure 1C:
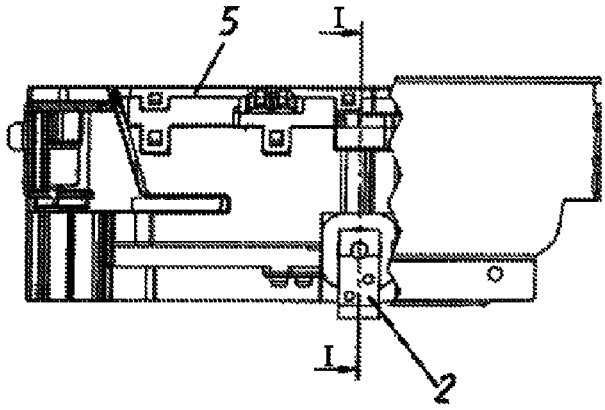
Figure 1D:
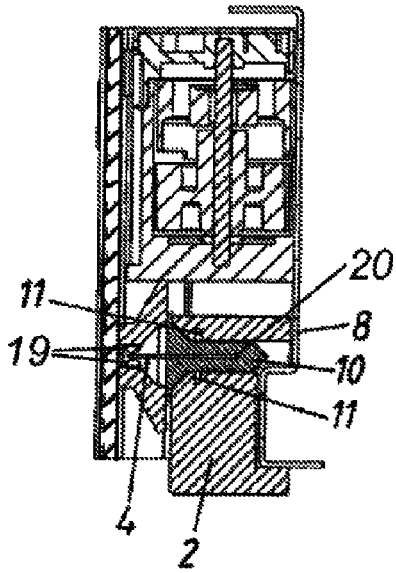
Figure 1E:
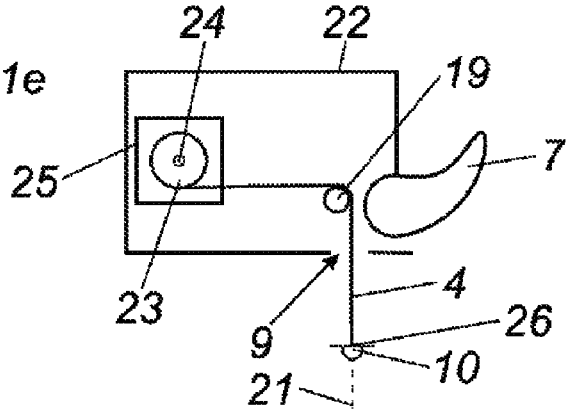

The pulling member 4 is passed out of the housing 22 of the drive 5 by way of (adjustably guided by) deflection rollers 19 (not shown in FIG. 1*b*, but see FIG. 1*d*) and a window 9. The deflection rollers 19 compensate for positional tolerances in directions which extend orthogonally with respect to the line of action 21 of the drive 5 (in all the Figures, the direction of movement of the pulling member 4 outside the housing). As shown in FIG. 1*b*, the window 9 is larger than a cross-section of the pulling member 4 so as to allow the second coupling part 3 to have limited movement in a direction orthogonal to the notional line of action 21 of the drive 5 (see also the schematic diagram of FIG. 1*e*). To compensate for positional tolerances in the direction of the line of action of the drive 5, the second part 3 has a grooved pin 10 (i.e., the pin 10 has circumferential grooves 20), the first part 2 being of such a configuration that the pin 10 can be locked with any individual groove 20 of pin 10 in the first part 2, more specifically by way of clamping jaws 11 (see the sectional view in FIG. 1*d*).

In all embodiments, the movable furniture part 8 is in the form of a drawer.

The coupling 1*a* also has a two-part structure in the embodiment of FIGS. 2*a* through 2*d*. In this case, once again the second part 3*a* has a grooved pin 10*a* which can provide for compensation in the direction of the line of action of the drive 5.

To provide for compensation in respect of positional tolerances in a direction orthogonal to the line of action of the drive 5, the first coupling portion 2*a* has a capture part 13 which is mounted on a slide 12 and which has of a funnel-shaped configuration.

In this case, the slide 12 is mounted limitedly displaceable along two orthogonal directions.

In the embodiment of FIGS. 3*a* through 3*d* the coupling 1*b* has a one-part configuration and has a coupling portion in the form of a magnet 14. In this case the magnet 14 is connected to the free end of the pulling means 4. The mobility of the pulling means 4 and the fact that in principle the magnet 14 can cling to any location on the metallic furniture part 8 provide a compensating option for positional tolerances both in the line of action of the drive 5 and orthogonally thereto.

The embodiment of FIGS. 4*a* through 4*d* again has a two-part coupling 1*c*. This corresponds to the coupling 1 shown in FIGS. 1*a* through 1*d*, with the differences that the second coupling portion 3*c* is mounted pivotably relative to the housing of the drive 5 (the part 15 is mounted pivotably by way of the joint 16 to the housing of the drive 5). The pulling means 4 is passed out of the housing of the drive 5 in the rear-wall region of the portion 15 and connected with the free end to the second part 3*c* of the coupling 1*c*.

Figure 2A:
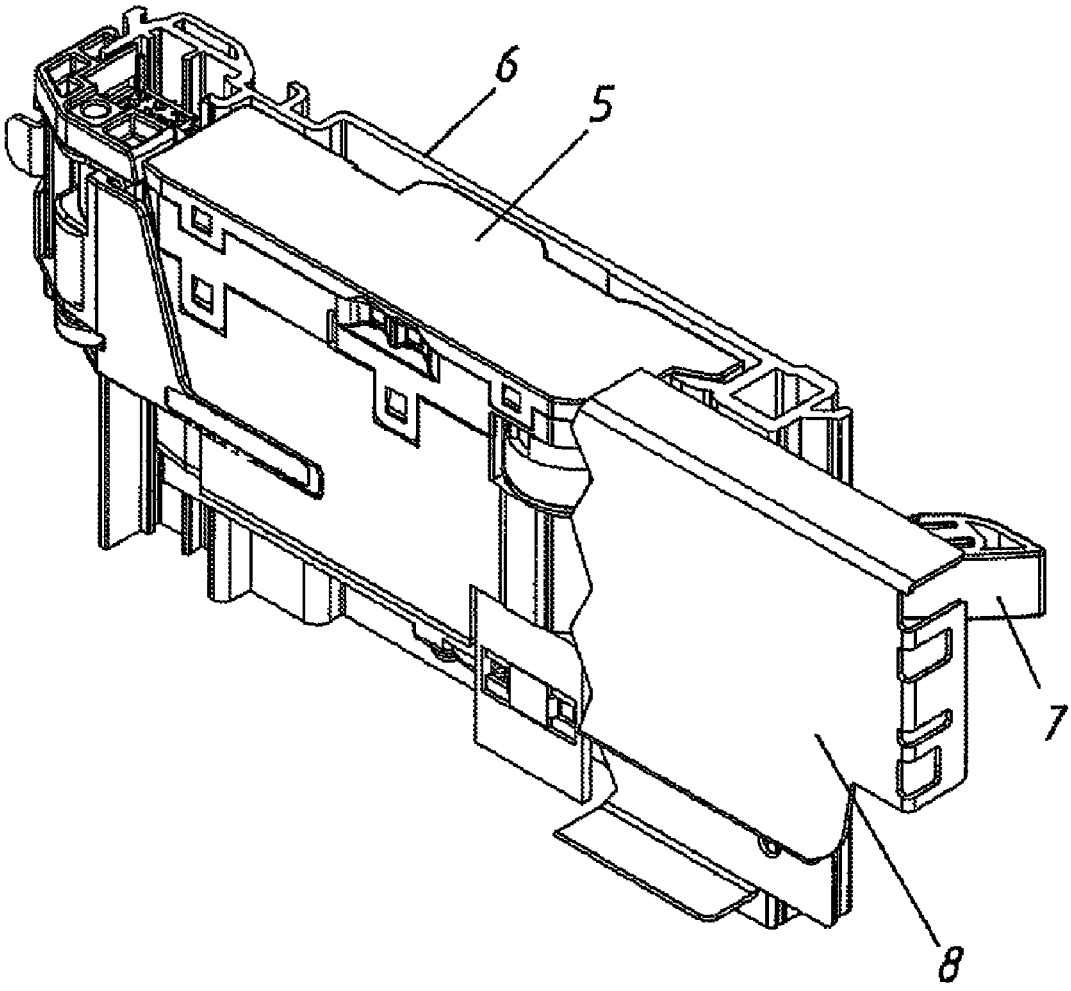
Figure 2B:
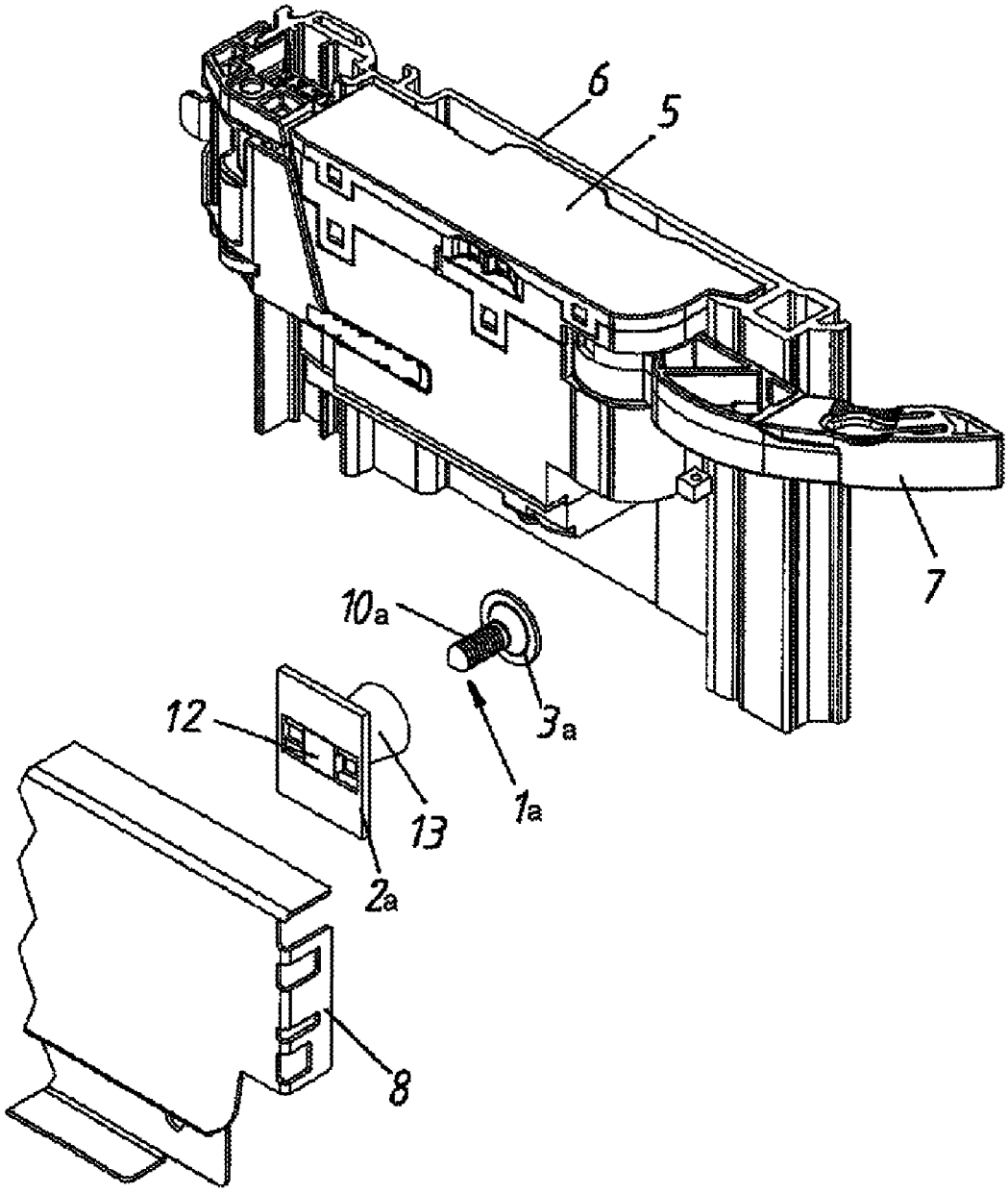
Figure 2C:
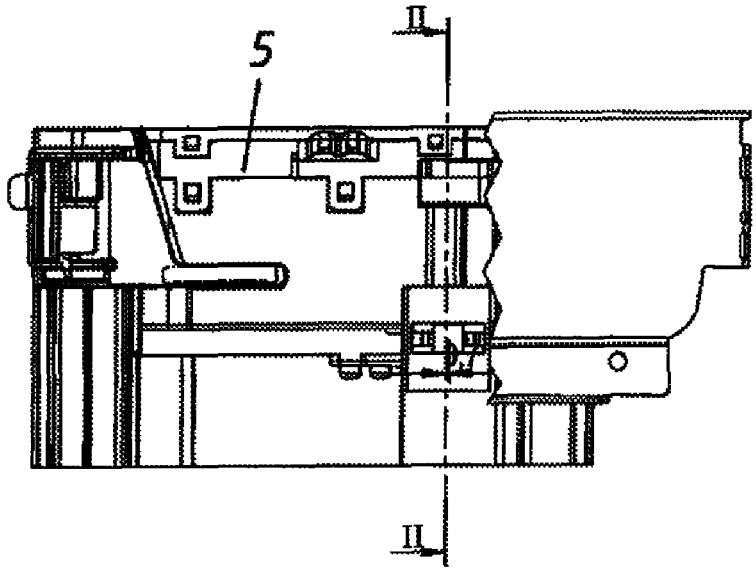
Figure 2D:
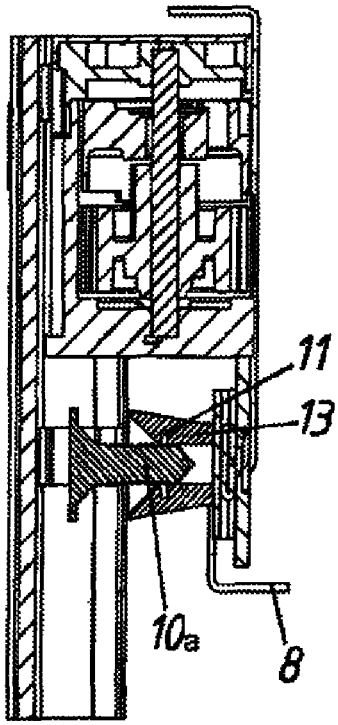
Figure 3A:
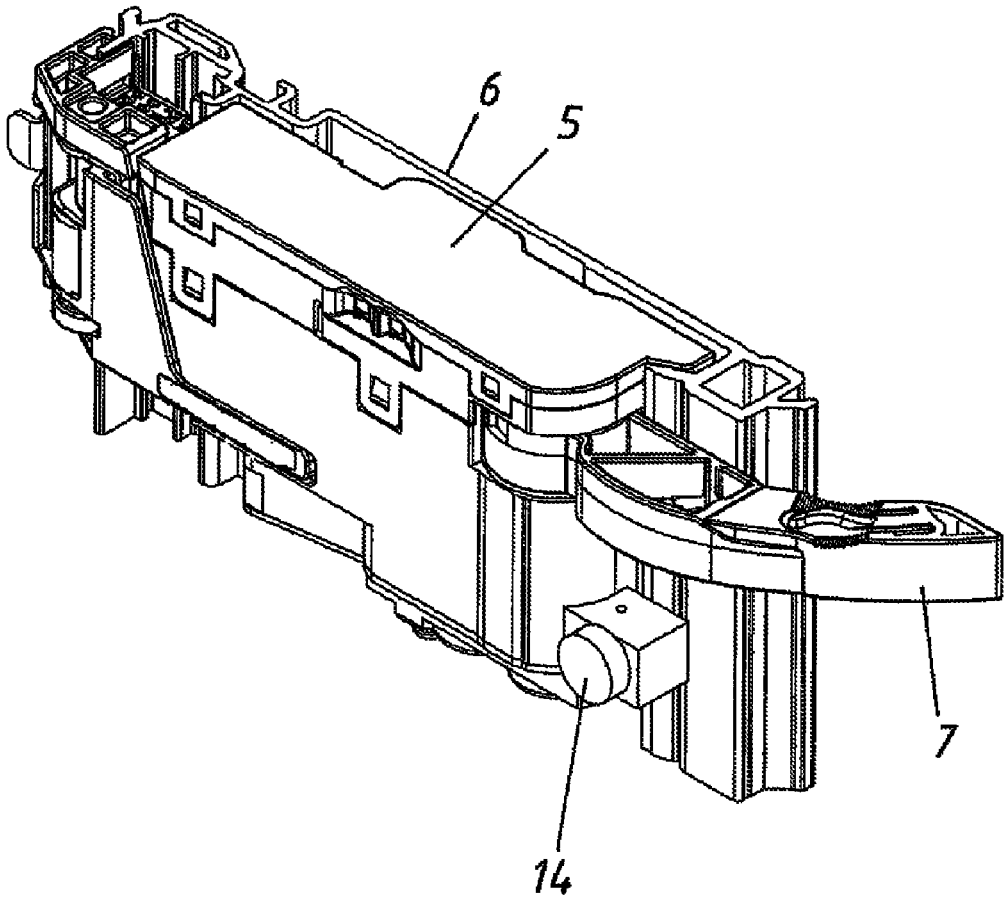
Figure 3B:
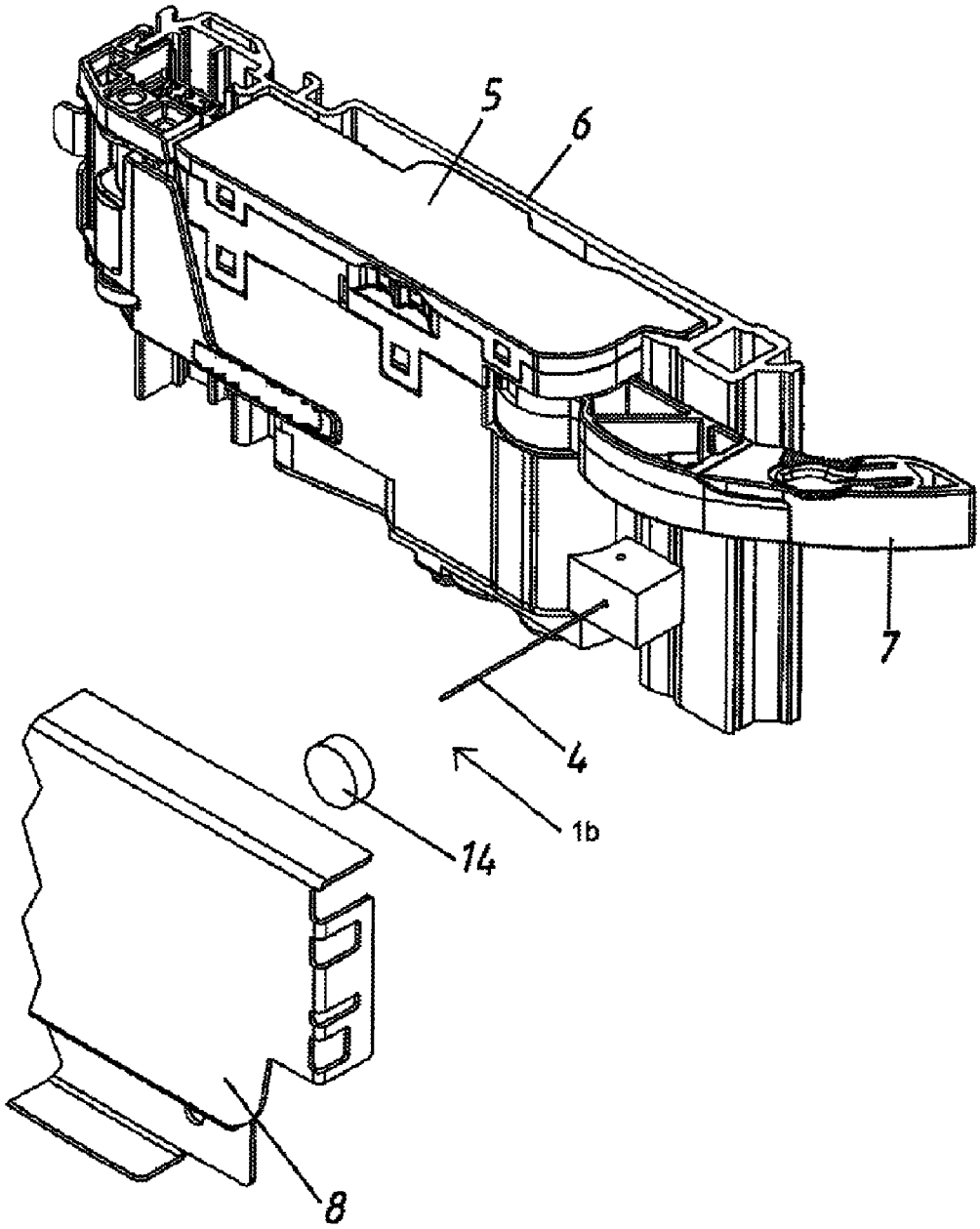
Figure 3C:
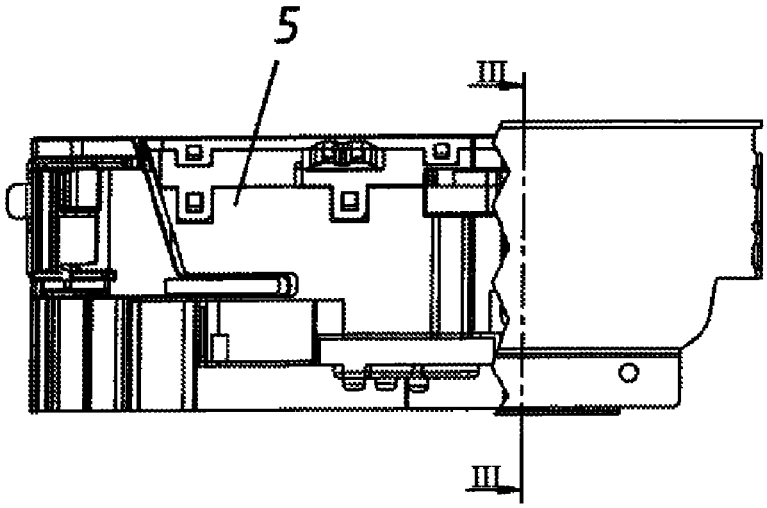
Figure 3D:
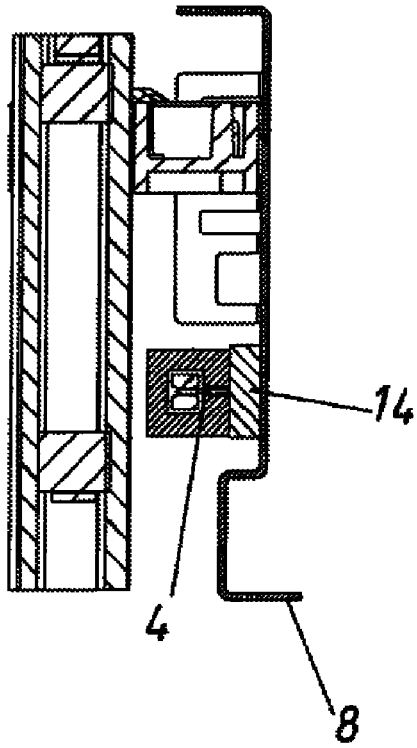
Figure 4A:
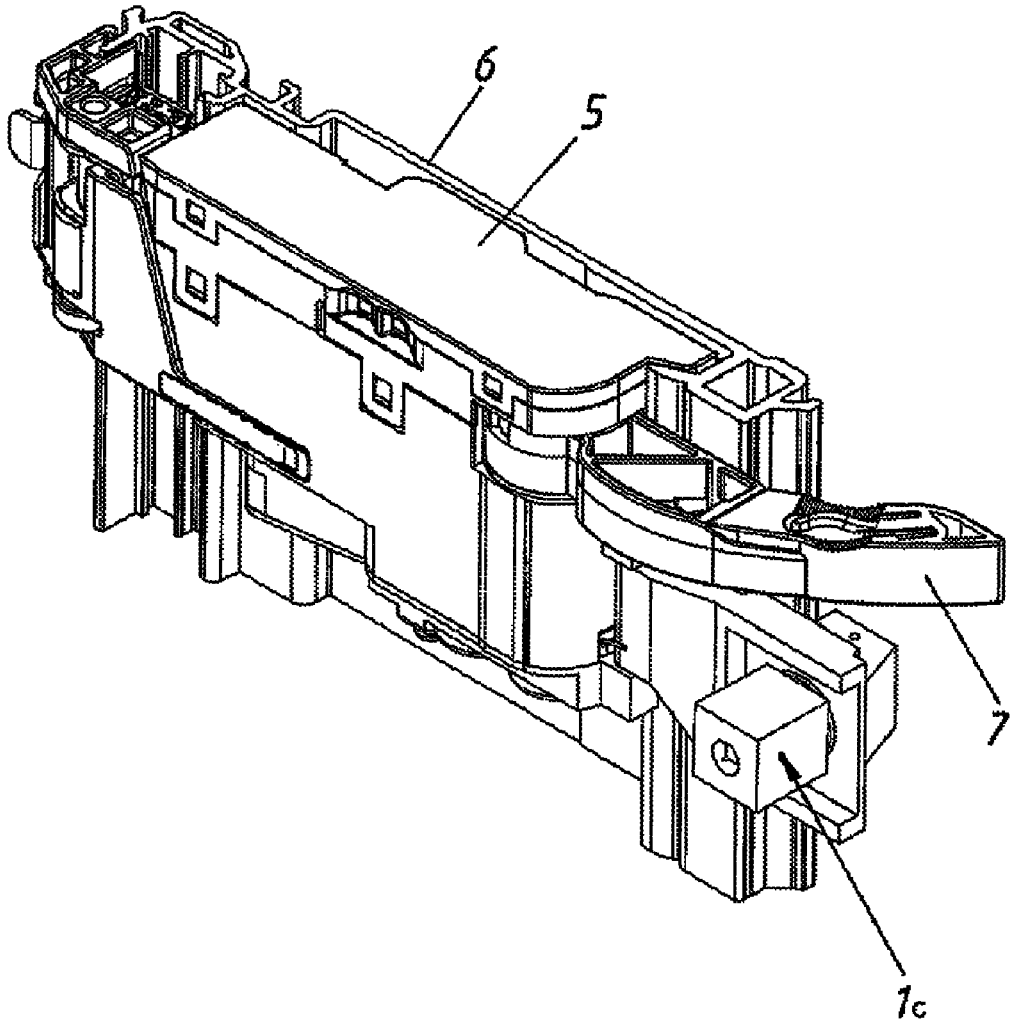
Figure 4B:
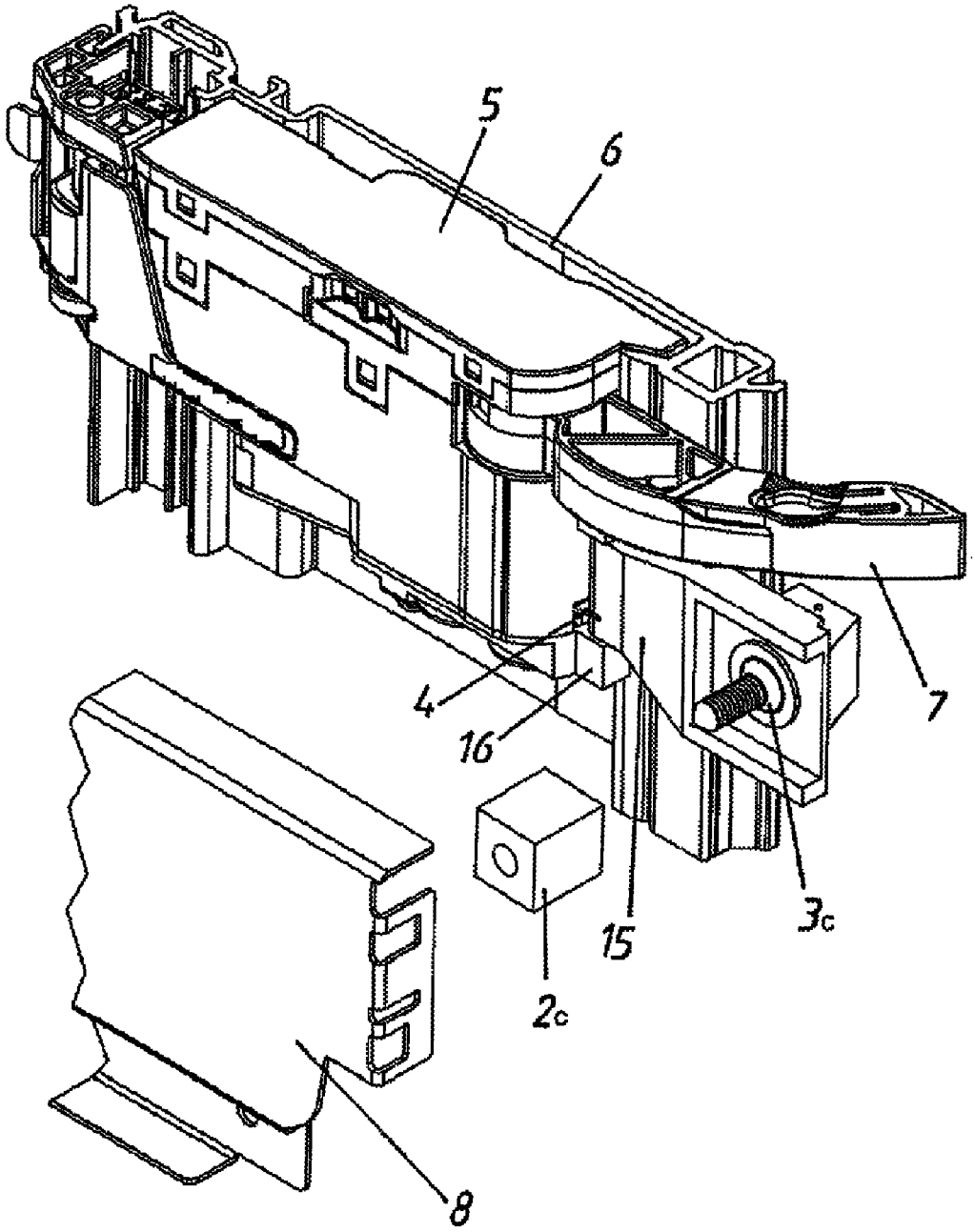
Figure 4C:
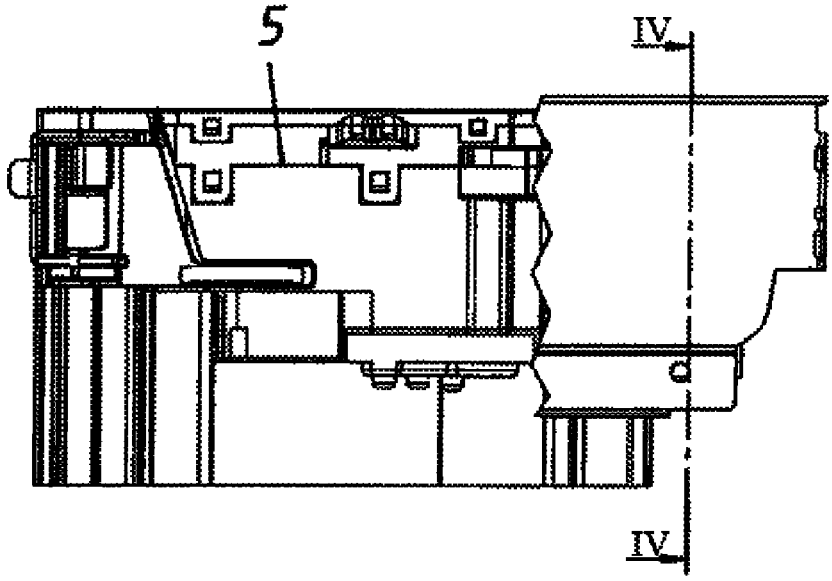
Figure 4D:
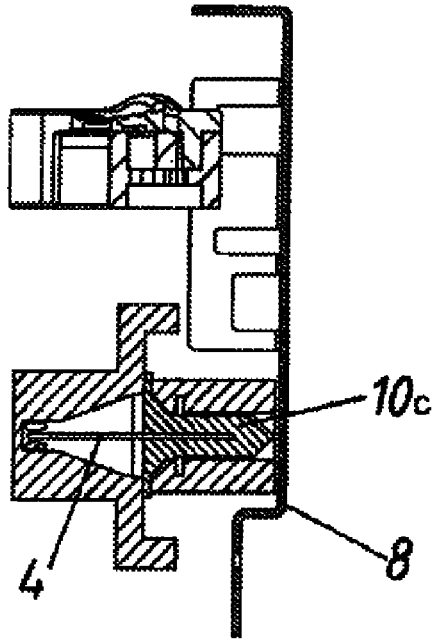
Figure 5C:
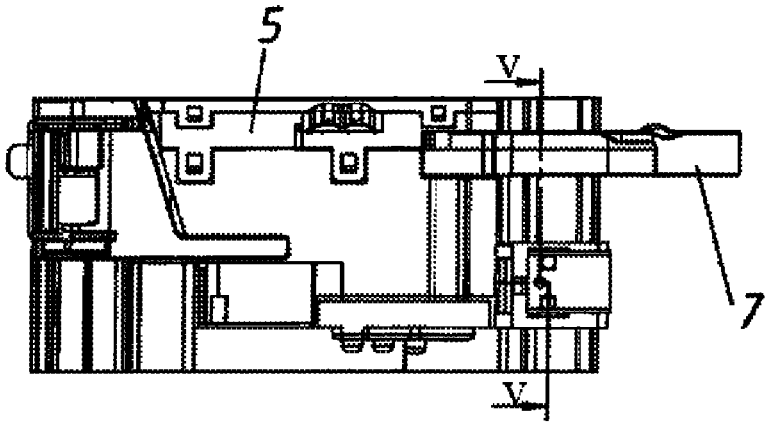
Figure 5D:
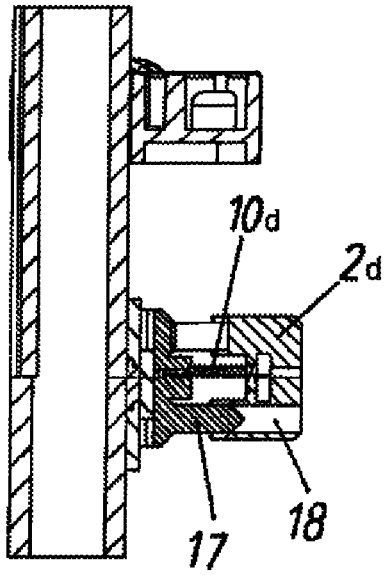

In the embodiment of FIGS. 5*a* through 5*d* the second part 3*d* of the coupling 1*d* is mounted on a slide 12*d* (corresponding to FIG. 2*a*). The second part 3*d* again has a grooved pin 10*d*. The slide 12*d* is mounted limitedly movably along two mutually orthogonal directions. Provided for centering the pin 10*d*, there are two centering pins 17 engaging into corresponding openings 18 on the first part 2*d* of the coupling 1*d*. The first part 2*d* is again arranged at the rear wall of a movable furniture part 8 (not shown in FIGS. 5*a* through 5*d*).

The invention claimed is:

1. A coupling arrangement comprising:

a drive including a pulling member wound on a roller driven by a motor such that a notional line of action of said drive is orthogonal to an axis of rotation of said roller; and a coupling portion for releasably connecting a movable furniture part to said drive, said coupling portion including a first coupling part to be mounted to the movable furniture part and a second coupling part mounted to said drive, said first coupling part being releasably coupled to said second coupling part, a free end of said pulling member being connected to said second coupling part;

wherein said drive further includes a housing having a window for allowing said pulling member to extend from said housing, said window being larger than a cross-section of said pulling member so as to allow said second coupling part to have limited movement in a direction orthogonal to the notional line of action of said drive so as to compensate for positional tolerances.

2. The coupling of claim 1, wherein said first coupling part and said second coupling part are configured so as to be adjustably coupled to each other along the notional line of action of said drive.

3. The coupling of claim 2, wherein said second coupling part includes a pin having a plurality of circumferential grooves, and said first coupling part includes clamping jaws for engaging one of said grooves in said pin so as to allow a position of said second coupling part to be adjusted relative to a position of said first coupling part along the notional line of action of said drive.

4. The coupling of claim 3, wherein said drive further includes deflection rollers configured to adjustably guide said pulling member such that said pulling member is movable within said window of said housing in a direction orthogonal to the notional line of action of said drive.

5. The coupling of claim 1, wherein said drive further includes deflection rollers configured to adjustably guide said pulling member such that said pulling member is movable within said window of said housing in a direction orthogonal to the notional line of action of said drive.

6. The coupling of claim 1, wherein said drive further includes an ejection lever, and wherein said pulling member, said roller, and said motor form a pull-in retraction device of said drive.

7. The coupling of claim 1, wherein said second coupling part comprises a magnet connected to said free end of said pulling member.

8. The coupling of claim 1, wherein said second coupling part is mounted on a slide displaceable in two mutually orthogonal directions which each extend orthogonally with respect to the notional line of action of said drive.

9. The coupling of claim 1, wherein said second coupling part is mounted so as to be pivotable relative to said housing.

* * * * *